US006164253A

United States Patent [19]

Alberter et al.

[11] Patent Number: 6,164,253

[45] Date of Patent: Dec. 26, 2000

[54] ACTUATORS OPERATING DEVICE FOR ELECTROMAGNETIC VALVE ACTUATION IN INTERNAL COMBUSTION ENGINES

[75] Inventors: Günther Alberter, Nürnberg; Hermann Bäumel, Neumarkt; Gunther Breu, Nürnberg; Werner Flierl, Sulzbach-Rosenberg; Matthias Gramann, Neunkirchen a. S.; Gerhard Hettich, Dietenhofen; Horst Kretschmer, Lautenbach; Kurt Maute, Sindelfingen; Jürgen Schenk, Albershausen; Wolfgang Thiel, Denkendorf; Werner Wiedemann, Herzogenaurach, all of Germany

[73] Assignees: Temic Telefunken microelectronic GmbH, Nürnberg; DaimlerChrysler AG, Stuttgart, both of Germany

[21] Appl. No.: 09/367,567

[22] PCT Filed: Dec. 3, 1998

[86] PCT No.: PCT/EP98/07879

§ 371 Date: Nov. 15, 1999

§ 102(e) Date: Nov. 15, 1999

[87] PCT Pub. No.: WO99/31359

PCT Pub. Date: Jun. 24, 1999

[30] Foreign Application Priority Data

Dec. 17, 1997 [DE] Germany ..... 197 56 095

[51] Int. Cl.[7] ..... F01L 9/04

[52] U.S. Cl. ..... 123/90.11; 123/90.38

[58] Field of Search ..... 123/90.11, 90.19, 123/90.38, 195 C, 198 E

[56] References Cited

U.S. PATENT DOCUMENTS

| | | | |
|---|---|---|---|
| 4,715,330 | 12/1987 | Buchl | 123/90.11 |
| 5,255,650 | 10/1993 | Faletti et al. | 123/322 |
| 5,720,242 | 2/1998 | Izuo | 123/90.11 |
| 5,785,016 | 7/1998 | Enderle et al. | 123/90.11 |

FOREIGN PATENT DOCUMENTS

| | | |
|---|---|---|
| 0798450A1 | 10/1997 | European Pat. Off. . |
| 2192242 | 2/1974 | France . |
| 4225329A1 | 2/1993 | Germany . |
| 19611547A1 | 9/1997 | Germany . |

*Primary Examiner*—Weilun Lo
*Attorney, Agent, or Firm*—Venable; George H. Spencer; Robert Kinberg

[57] ABSTRACT

The invention relates to an apparatus for operating actuators for electromagnetic valve control in internal-combustion engines.

12 Claims, 3 Drawing Sheets

Figure 2:
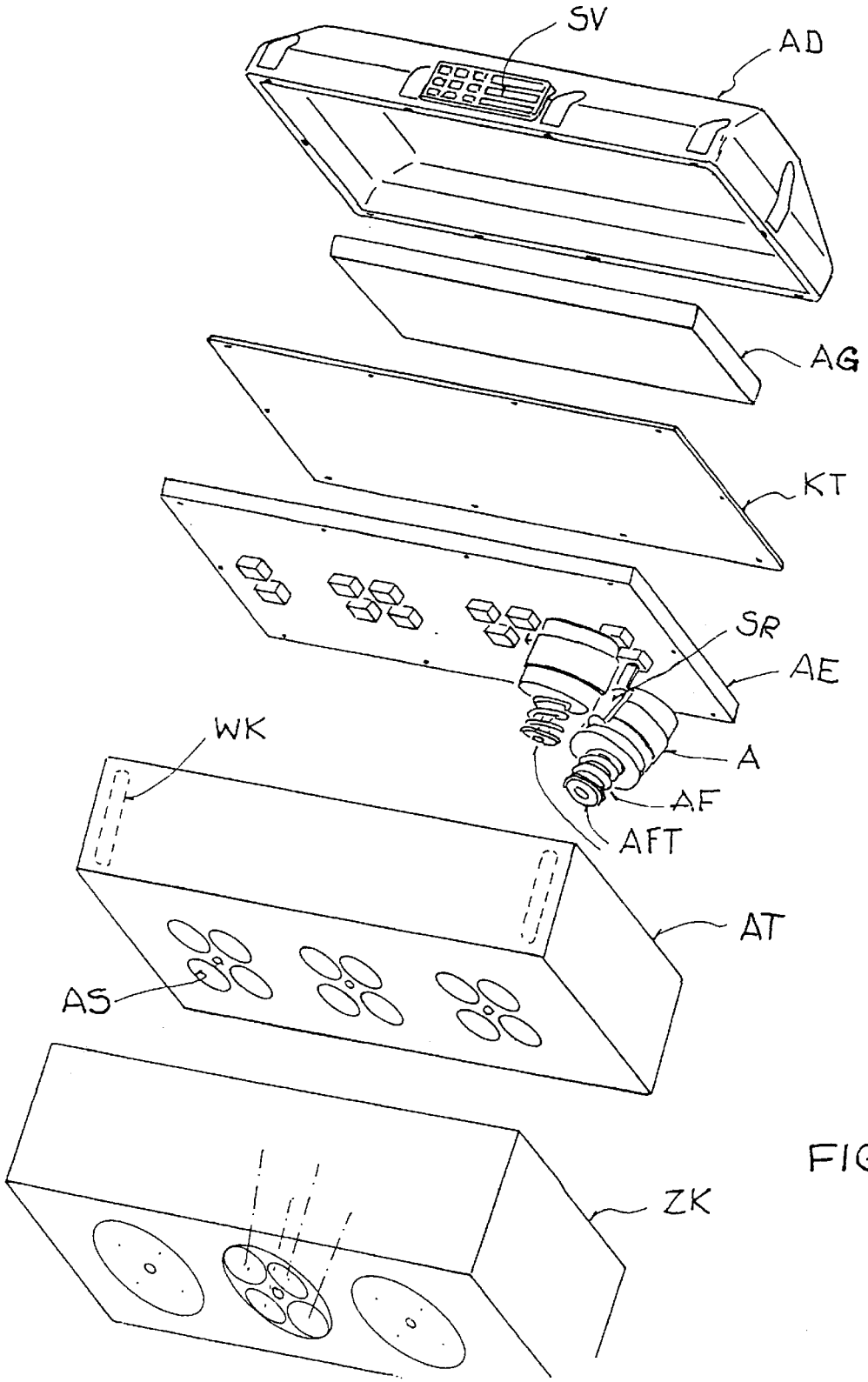

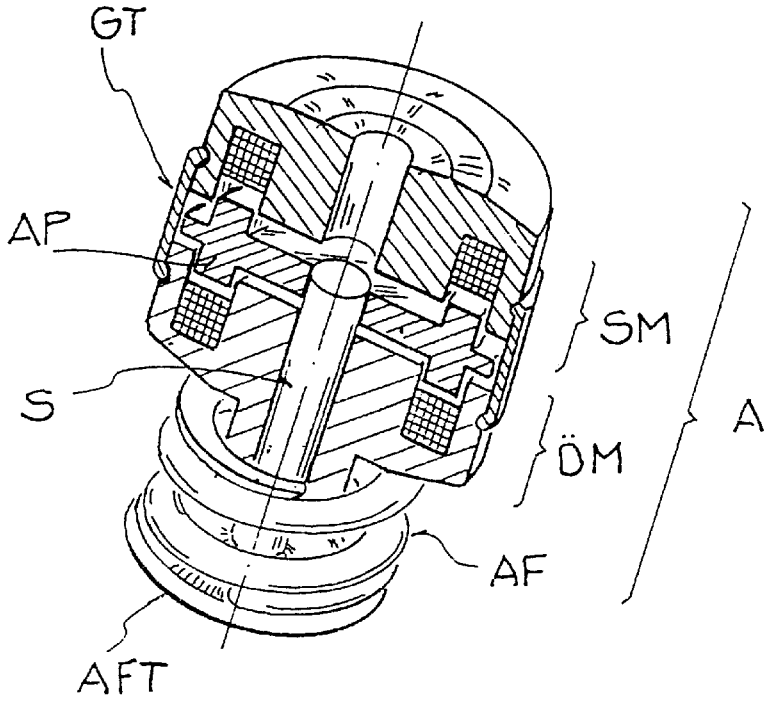
FIG. 1
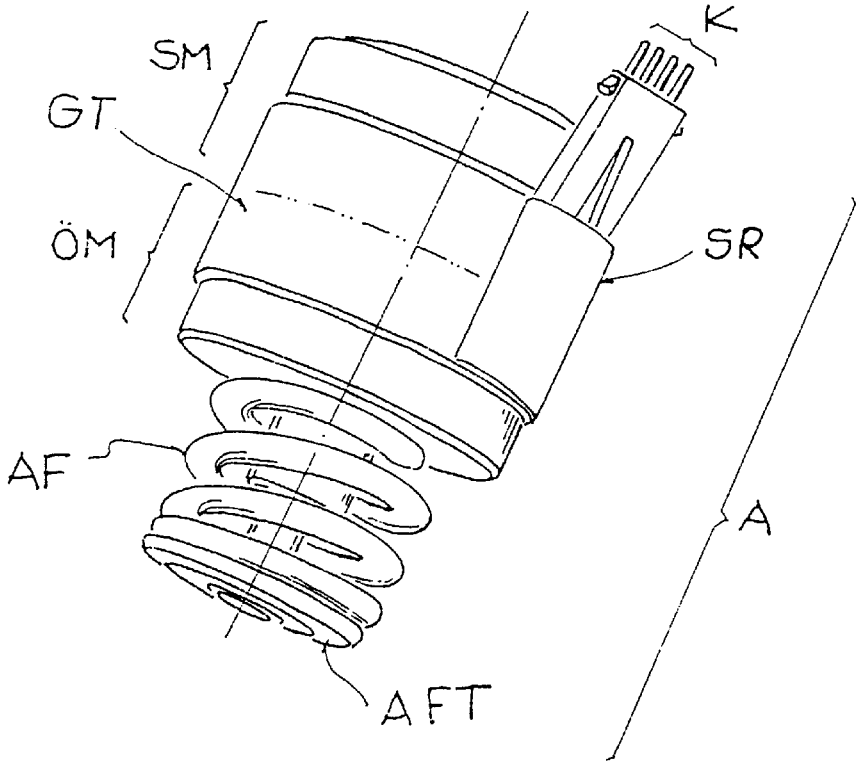

ACTUATORS OPERATING DEVICE FOR ELECTROMAGNETIC VALVE ACTUATION IN INTERNAL COMBUSTION ENGINES

The invention relates to an apparatus for operating actuators for electromagnetic valve control in internal-combustion engines.

The actuators, which are embodied as a separate assembly, essentially comprise an opening magnet and a closing magnet, which are connected to one another by at least one housing part. The opening magnet and the closing magnet are electromagnets respectively comprising an exciter coil and a yoke. The exciter coils of the electromagnets are supplied with current by way of a plurality of contacts guided out of the housing part by a plug. A tie plate comprising a ferromagnetic substance is located between the opening magnet and the closing magnet. The tie plate is moved in the respective direction through the supply of the opening-magnet exciter coil or the closing-magnet exciter coil with current. The opening magnet has a lead-through for a plunger that connects the tie plate to an actuator spring plate. An actuator spring is disposed between the actuator spring plate and the housing part or the outside of the opening magnet.

An actuator and a cylinder valve form a functional unit, with the cylinder valve being drawn into the valve seat of the cylinder head by means of a valve spring and a valve spring plate, corresponding to a conventional cylinder head having cam shafts.

When a functional unit comprising an actuator and a cylinder valve is mounted to the internal-combustion engine, the actuator spring plate and the valve spring plate are pressed together. In the inoperative position of the functional unit, the tie plate is exactly in the center between the opening magnet and the closing magnet. The cylinder valve is located in a central position between the valve seat of the cylinder head, in which position the valve is closed, and the position in which the valve is at its maximum opening.

Because the power consumption of an actuator can be in the range of several hundred Watts, precautions must be taken to cool the actuators or carry off the unavoidable heat buildup.

The actuators are actuated by way of an actuator control device that controls the valve clearance of the internal-combustion engine by determining the beginning and duration of the current supply of the opening and closing magnets. To this end, the actuator control device requires sensor data for determining the crankshaft rpm and the crankshaft angle of rotation, for example.

At least two actuators are necessary for an internal-combustion engine employing two-valve technology and having one cylinder. In a four-valve internal-combustion engine having six cylinders, up to 24 actuators are integrated into a cylinder head.

It is the object of the invention to provide an apparatus for operating actuators for electromagnetic valve control in internal-combustion engines, in which the actuator arrangement is easily accessible for maintenance work, cooling is assured and the connection to the actuator control device is effected.

In accordance with the invention, this object is accomplished with the actuators being embodied as a discrete assembly for electromagnetic valve control and disposed in actuator shafts in an actuator carrier. An actuator control device that is connected to further control devices, engine sensors and the current supply is disposed on the actuator carrier.

The internal-combustion engine has a cylinder head, to which the actuator carrier is mounted, with non-positive lockup and in a form fit, as a separate assembly.

The actuator shafts in the actuator carrier are surrounded by cooling-medium channels that are connected to cooling-medium channels of the cylinder head, or to a cooling-medium circuit of the internal-combustion engine.

In a modification of the invention, it is provided that the further control devices are integrated into the actuator control device.

In a further modification of the invention, it is provided that the actuator carrier has a cover that surrounds the actuator control device; it may serve simultaneously as the logo plate of the engine manufacturer, and be made of plastic, for example. The cover has a plug apparatus that connects the actuator control device to external electronic components.

A pressed screen, which has pressed-screen connectors and is injected into a plastic part, is disposed between the actuators and the control device; the pressed-screen connectors of the pressed screen are contacted with the contacts of the actuator plugs, and the ends of the pressed screen opposite the pressed-screen connectors are contacted with the actuator control device.

In an advantageous modification of the invention, it is provided that a cooled intermediate level, advantageously comprising an aluminum plate, is disposed between the actuator carrier and the actuator control device.

The cooled intermediate level has lead-throughs for the pressed-screen connectors of the pressed screen.

In addition, the cooled intermediate level is connected to the cooling-medium channels of the cylinder head, or to the cooling-medium circuit of the internal-combustion engine.

Due to the compact design of the apparatus of the invention for operating actuators for electromagnetic valve control in internal-combustion engines, the actuator control device is disposed in the immediate vicinity of the actuators, thereby assuring the cooling of the actuator control device and the actuators. The layered design makes the actuators easily accessible for maintenance work.

Figure 3:
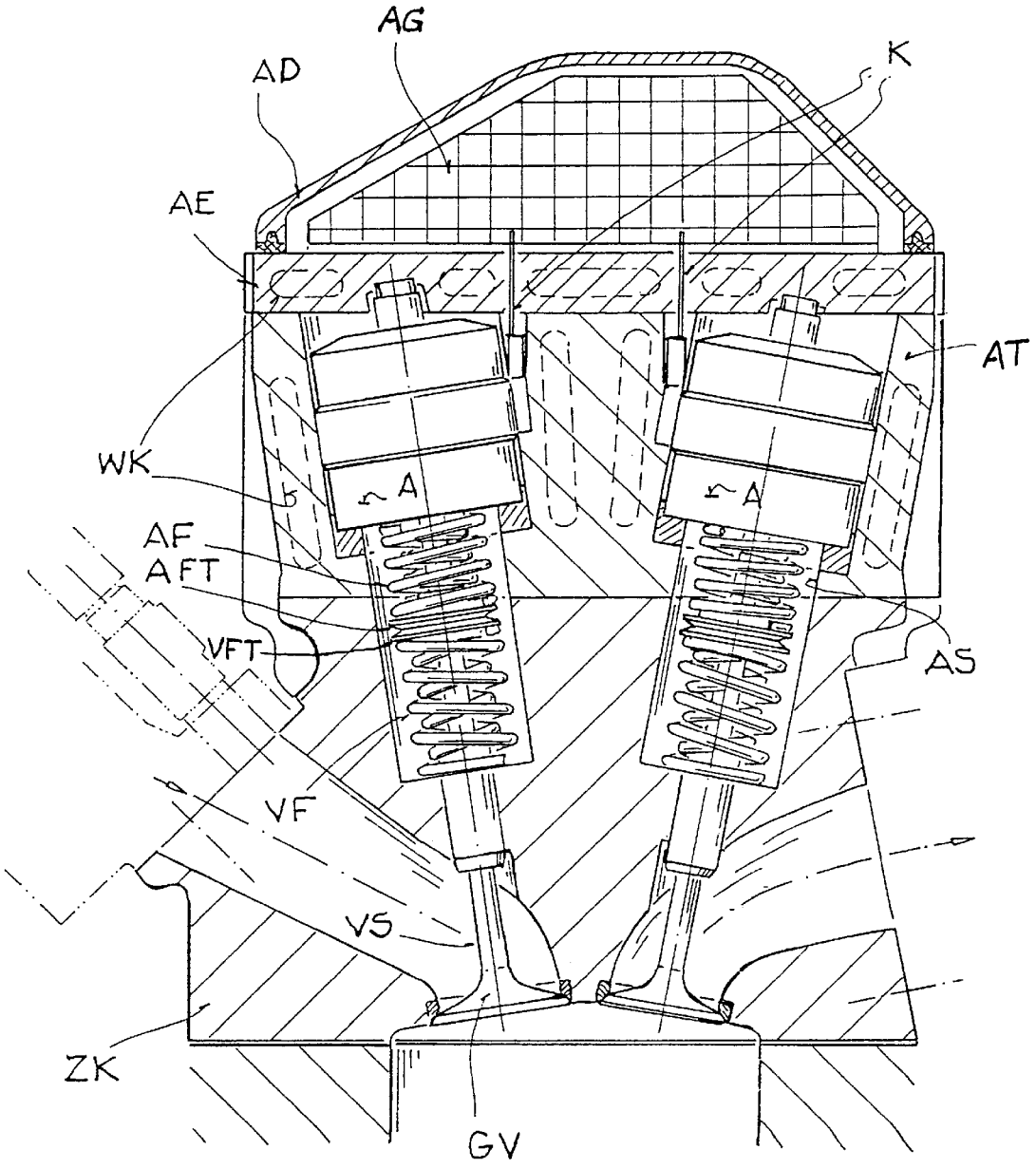

The apparatus of the invention for operating actuators for electromagnetic valve control is described below by way of an embodiment for a piston-type internal-combustion engine having four cylinders disposed in series, with reference to three figures, which show in:

FIG. 1 schematically, a sectional view through an actuator embodied as a separate assembly;

FIG. 2 a schematic representation of the layered design of the apparatus for operating actuators for electromagnetic valve control in a four-cylinder straight engine; and FIG. 3 schematically, a section through a piston-type internal-combustion engine of the actuator carrier, with the actuators, the cooled intermediate layer, the multi-functional plastic part and the cover.

FIG. 1 shows an actuator A embodied as a pre-mounted assembly. The actuator A essentially comprises an opening magnet ÖM having a lead-through, and a closing magnet SM, which are connected to one another by a housing part GT. The opening magnet ÖM and the closing magnet SM are electromagnets respectively comprising a yoke and an exciter coil. A circular tie plate AP comprising a ferromagnetic substance is disposed between the opening magnet ÖM and the closing magnet SM. The tie plate AP is connected to an actuator spring plate AFT by way of a plunger S. The plunger S is guided through the lead-through of the opening magnet ÖM. An actuator spring AF, which effects the resetting of the tie plate AP once the plate has been attracted by the closing magnet SM, is disposed between the actuator spring plate AFT and the opening magnet ÖM.

FIG. 2 shows the layered design of the apparatus for operating actuators A for electromagnetic valve control in a four-cylinder internal-combustion engine of a motor vehicle. The cylinders of the internal-combustion engine are embodied in four-cylinder technology, with an actuator A being provided for each cylinder valve GV. Sixteen actuators A are disposed in the actuator shafts AS of the actuator carrier AT. The actuator carrier AT is screwed to the cylinder head ZK of the internal-combustion engine with non-positive lockup and a form fit.

An actuator A and a cylinder valve GV form a functional unit. The cylinder valves GV are mounted in the cylinder head ZK of the piston-type internal-combustion engine. The cylinder valves GV are drawn into the valve seat of the cylinder head ZK by a respective valve spring VF by way of a valve spring plate VFT secured to the valve stem vs of the cylinder valve GV. In the inoperative position of a functional unit comprising a cylinder valve GV and an actuator A, the actuator spring plate AFT and the valve spring plate VFT are pressed against one another, positioning the tie plate AP exactly in a central position between the opening magnet ÖM and the closing magnet SM. The valve spring VF effects the resetting of the tie plate AP in this central position after the actuator spring plate AFT has been attracted by the opening magnet ÖM for opening the cylinder valve GV.

The actuator shafts AS serving to receive the actuators A are respectively routed at an angle to the floor surface of the actuator carrier such that the plunger of the actuators A forms a straight line with the valve stem VS of the cylinder valves GV. Each actuator shaft AS of an actuator carrier AT has an apparatus for fixing the actuators A. This apparatus can be embodied as, for example, a bayonet catch.

After the actuator carrier AT has been mounted to the cylinder head ZK of the piston-type internal-combustion engine, the actuators A are positioned in the actuator shafts AS. In the process, the plugs SR of the actuators A protrude from the actuator carrier AT with the contacts K. The contacts K are connected to the exciter coil of the opening magnet ÖM and the exciter coil of the closing magnet SM. In addition to the actuator shafts AS, the actuator carrier AT includes cooling-water channels WK, which surround each actuator A and are connected by way of the cylinder head ZK to the cooling-water circuit of the internal-combustion engine. The cooling water located in the cooling-water channels WK of the actuator carrier AT forms a water jacket that contributes significantly to damping the sound waves that result during the operation of the actuators A.

A cooled intermediate level embodied as an aluminum plate AE is mounted to the actuator carrier AT with the actuators A. The aluminum plate AE likewise has cooling-water channels WK, which are cut horizontally into the aluminum plate AE and are connected to the cooling-water channels WK of the actuator carrier AT. The cooling-water channels WK of the actuator carrier AT and the aluminum plate AE are likewise connected to the cooling-water circuit of the internal-combustion engine by way of cooling-water hoses that lead out laterally.

The aluminum plate AE has lead-throughs for pressed-screen connectors of a pressed screen. The pressed screen is injected into a multi-functional plastic part KT that is secured to the aluminum plate AE. The plastic part KT assumes the function of insulating the pressed screen SG, for example from the aluminum plate AE.

The lead-throughs of the aluminum plate AE, into which the multi-functional plastic part KT is inserted with the pressed-screen connectors, are embodied as solid mechanical plug sites. The plugs SR of the actuators A are fixed to the contacts K by means of these plug sites, and the pressed-screen connectors of the pressed screen are reliably electrically connected to the contacts K of the plugs SR of the actuators A.

An actuator control device AG that assumes all functions necessary for controlling the actuators A is mounted to the multi-functional plastic part KT. The actuator control device AG is connected to the current supply of the motor vehicle, and to engine sensors.

The engine sensors permit the actuator control device AG to determine the crankshaft angle of rotation and the crankshaft rpm. In addition, the actuator control device AG can be connected to further sensors, which, for example, ascertain the load state of the piston-type internal-combustion engine.

The cooling of the aluminum plate AE protects the actuator control device AG from excessive heating due to the large heat buildup during the operation of the actuators A.

The aluminum plate AE, the multi-functional plastic part KT and the actuator control device AG are covered by a cover AD. The cover AD is made of plastic, and serves simultaneously as the logo plate of the engine or vehicle manufacturer. The cover AD prevents moisture from entering the interior of the cover. A plug apparatus SV, by means of which the actuator control device AG is connected to the current supply, further control devices and further engine sensors, is provided to the side of the cover AD.

FIG. 3 is a section through the apparatus for operating actuators A for electromagnetic valve control, in the assembled state. The figure primarily shows the compact design of the apparatus.

In the event of a defect, the plug apparatus SV is removed from the cover AD for repair work. Afterward, the cover AD itself can be disassembled. The actuator control device AG, the multi-functional plastic part KT with the pressed screen, and the aluminum plate AE are disassembled together. Of the exposed actuators A, the defective actuator can now be lifted out of the actuator shaft AS of the actuator carrier AT. This is effected, for example, with a special tool that is used to rotate the bayonet catch by one-quarter turn to release the catch.

What is claimed is:

1. An apparatus for operating actuators (A) for electromagnetic valve control in internal-combustion engines, in which the actuators (A) are embodied as a discrete assembly and respectively have a plug (SR) with a plurality of contacts (K), characterized in that the actuators (A) are disposed in actuator shafts (AS) in an actuator carrier (AT); an actuator control device (AG) is disposed on the actuator carrier (AT); and the actuator control device (AG) is connected to further control devices, engine sensors and the current supply.

2. The apparatus according to claim 1, characterized in that the internal-combustion engine has a cylinder head (ZK), and the actuator carrier (AT) is mounted, as a separate component, on the cylinder head (ZK).

3. The apparatus according to claim 1, characterized in that the actuator shafts (AS) in the actuator carrier (AT) are surrounded by cooling-medium channels (WK), which are connected to cooling-medium channels of the cylinder head (ZK), or to a cooling-medium circuit of the internal-combustion engine.

4. The apparatus according to claim 1, characterized in that the further control devices are integrated into the actuator control device (AG).

5. The apparatus according to claim 1, characterized in that the actuator carrier (AT) has a cover (AD) that surrounds the actuator control device (AG).

6. The apparatus according to claim 5, characterized in that the cover (AD) serves as a logo plate.

7. The apparatus according to claim 5, characterized in that the cover (AD) is made of plastic.

8. The apparatus according to claim 1, characterized in that a pressed screen that has been injected, with pressed-screen connectors, into a plastic part (KT) is disposed between the actuators (A) and the actuator control device (AG), with the pressed-screen connectors of the pressed screen being contacted with the contacts (K) of the plugs (SR) of the actuators (A), and with the pressed screen being contacted with the actuator control device (AG).

9. The apparatus according to claim 1, characterized in that a cooled intermediate level (AE) is disposed between the actuator carrier (AT) and the actuator control device (AG).

10. The apparatus according to claim 9, characterized in that the cooled intermediate level (AE) is embodied as an aluminum plate.

11. The apparatus according to claim 9, characterized in that the cooled intermediate level (AE) has lead-throughs for the pressed-screen connectors of the pressed screen.

12. The apparatus according to claim 9, characterized in that the cooled intermediate level (AE) is connected to the cooling-medium channels of the cylinder head (ZK), or to a cooling-medium circuit of the internal-combustion engine.

* * * * *